US009295309B1

(12) United States Patent
Makhoulian et al.

(10) Patent No.: US 9,295,309 B1
(45) Date of Patent: Mar. 29, 2016

(54) JEWELRY WITH INTERCHANGEABLE DECORATIVE ELEMENTS

(71) Applicant: Richline Group, New York, NY (US)

(72) Inventors: Mossig H. Makhoulian, New York, NY (US); Ralph S. Rossini, New York, NY (US)

(73) Assignee: Richline Group, New York, NY (US)

( * ) Notice: Subject to any disclaimer, the term of this patent is extended or adjusted under 35 U.S.C. 154(b) by 0 days.

(21) Appl. No.: 14/560,799

(22) Filed: Dec. 4, 2014

Related U.S. Application Data

(60) Provisional application No. 61/912,332, filed on Dec. 5, 2013.

(51) Int. Cl.
*A44C 7/00* (2006.01)

(52) U.S. Cl.
CPC ..... *A44C 7/002* (2013.01); *A44C 7/004* (2013.01)

(58) Field of Classification Search
CPC ..... A44C 7/00; A44C 7/004; A44C 17/02; A44C 17/0208
USPC ..... 63/40, 12, 900, 29.2
See application file for complete search history.

(56) References Cited

U.S. PATENT DOCUMENTS

| | | | | | |
|---|---|---|---|---|---|
| 253,667 | A * | 2/1882 | Bergfels | A44C 17/02 | 63/26 |
| 1,713,285 | A * | 5/1929 | Juergens | A44C 7/00 | 156/293 |
| 3,835,664 | A * | 9/1974 | Nesbit | A44C 9/02 | 63/15.6 |
| 4,052,864 | A * | 10/1977 | Hofsaess | A44C 17/0233 | 40/426 |
| 5,099,659 | A | 3/1992 | Carranza et al. | | |
| 5,432,986 | A * | 7/1995 | Sexton | A44C 5/2071 | 24/303 |
| 6,568,214 | B2 * | 5/2003 | Wolff | A44C 9/0038 | 63/15 |
| 6,594,871 | B2 | 7/2003 | Hoffman | | |
| 7,216,508 | B2 | 5/2007 | Kretchmer | | |
| 7,523,527 | B2 | 4/2009 | Garber | | |
| 2006/0117617 | A1 * | 6/2006 | Peterson | A44C 3/001 | 40/1.6 |
| 2007/0151294 | A1 * | 7/2007 | Williams | A44C 7/003 | 63/12 |
| 2008/0271296 | A1 | 11/2008 | Jepsen | | |
| 2011/0179823 | A1 * | 7/2011 | Moody | A44C 17/0208 | 63/4 |
| 2013/0160489 | A1 * | 6/2013 | Arjang | A44C 17/0208 | 63/1.12 |
| 2013/0269389 | A1 | 10/2013 | Spadaro | | |
| 2013/0327088 | A1 * | 12/2013 | Smith | A44C 17/0216 | 63/15 |
| 2014/0215859 | A1 * | 8/2014 | Leo | A43B 23/24 | 36/136 |

FOREIGN PATENT DOCUMENTS

| | | | | |
|---|---|---|---|---|
| CN | 200944894 | | 9/2007 | |
| CN | 202286636 | | 7/2012 | |
| CN | 202923173 | | 5/2013 | |
| DE | 10138989 | | 2/2002 | |
| DE | 10138989 | A1 * | 2/2002 | A44C 9/00 |
| EP | 0271423 | | 6/1988 | |
| EP | 2417866 | A1 * | 2/2012 | A44C 17/0216 |
| FR | 2703568 | A1 * | 10/1994 | A44C 7/00 |
| KR | 20050032633 | | 4/2005 | |
| WO | WO2006086311 | | 8/2006 | |
| WO | WO2007034470 | | 3/2007 | |

* cited by examiner

*Primary Examiner* — Emily Morgan
(74) *Attorney, Agent, or Firm* — Levisohn Berger LLP

(57) ABSTRACT

A base to hold replaceable decorative elements in which the decorative elements are magnetically held to the base with the base having a centering and locating pin to send into a recess in the decorative element facilitating the assembly of the earring parts.

3 Claims, 3 Drawing Sheets

JEWELRY WITH INTERCHANGEABLE DECORATIVE ELEMENTS

BACKGROUND OF THE INVENTION

The invention relates to a structure for interchangeable magnetically held decorative elements for jewelry. For instance, a jewelry item such as an earring may have a base housing having a central magnet and a projecting post to allow interchangeable decorative elements to be held in the base housing by magnetic attraction.

This invention is particularly directed to providing a pair of earrings with replaceable pearls or any other decorative structures held in the base housing by magnetic attraction. Other jewelry items can be used with this invention.

Consumers are increasingly desirous of personalizing their jewelry items which enables relatively inexpensive, changeable aesthetic appearances to be achieved inexpensively.

The present invention provides an earring having a base housing which includes a magnet and a projecting pin sized to fit into a rear aperture of a pearl or other similar structure which, itself, has a magnet so that as the pearl is slid onto the post the pearl is magnetically attracted and held by the base housing.

Interchangeable decorative pearls of different styles and colors for earrings or other interchangeable decorative elements having a rear recess suitable for seating onto a post may be provided to enable the consumer to easily and rapidly interchange pearls. The post in the housing fitting into the recess in the earring facilitates interchangeability by providing a guide (the pin) for the pearl to be slid onto and be held by the base housing. The height of the post is designed to facilitate easy insertion.

The invention will be more fully understood with reference to the photographs of the invention attached hereto.

DETAILED DESCRIPTION OF THE PREFERRED EMBODIMENT

Figure 2:
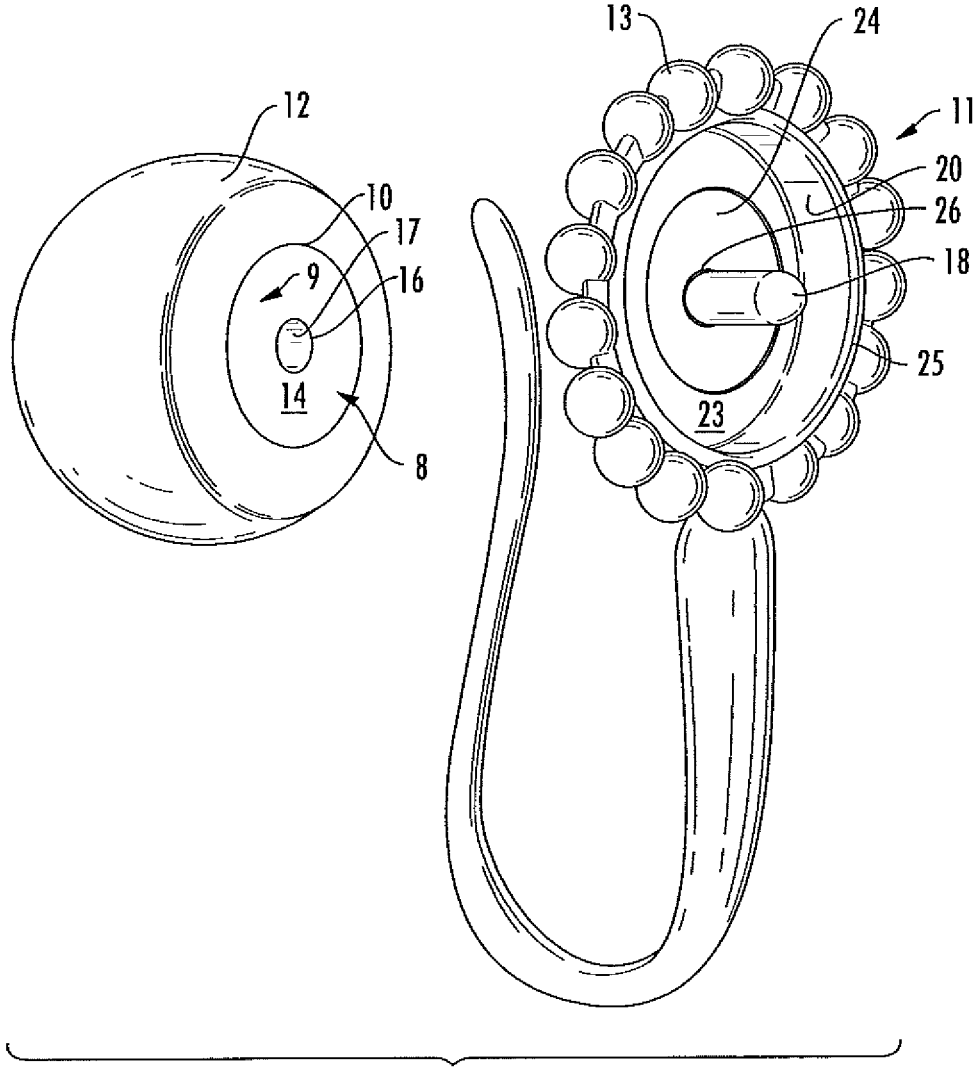
FIG. 2 is an exploded perspective view of the housing and the decorative element with magnetic center elements.
Figure 3:
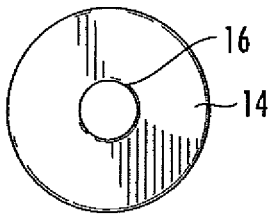
FIG. 3 is a front view of the magnet for the earring.
Figure 4:
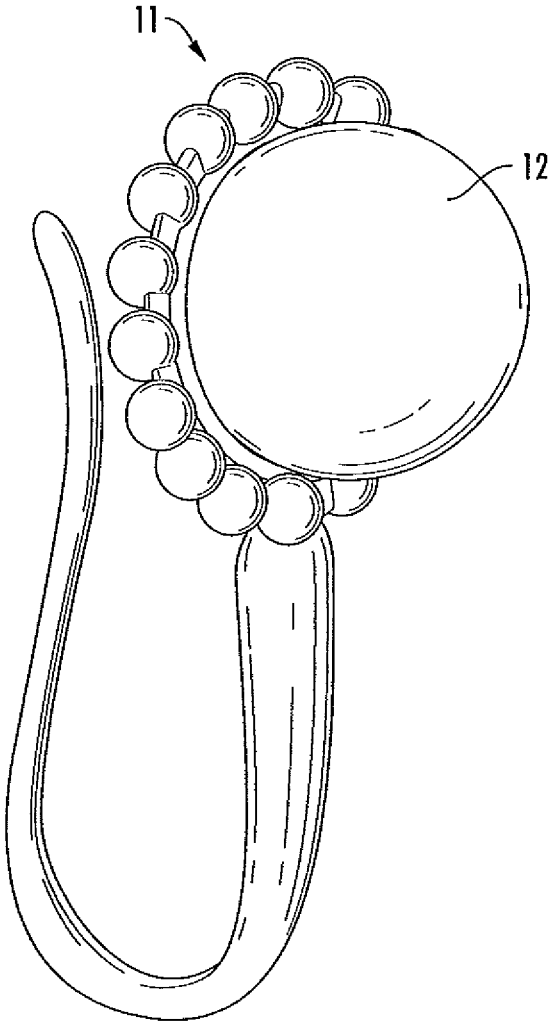
FIG. 4 is a front perspective view of an assembled earring of this invention.

FIG. 2 shows a decorative element 12 apart from base housing 11 with the rear 8 of decorative element 12 having a central portion 9 formed as a recess 10 by undercutting annular recess 10 into which a magnet 14 with a central aperture 16 is attached. Aperture 16 is the outer surface of a bore 17 formed in the rear of the decorative element 12 which is sized to receive a fitting pin. The magnet 14 could be glued or otherwise attached and held in recess 10.

While the above structure is shown for a pearl, any decorative element having a substantially flat back capable of holding magnet 14 or creating a recess 10 into which magnet 14 could be utilized with this invention. Further, the element should have sufficient depth to accommodate a post or pin, which will be explained below.

Figure 1:
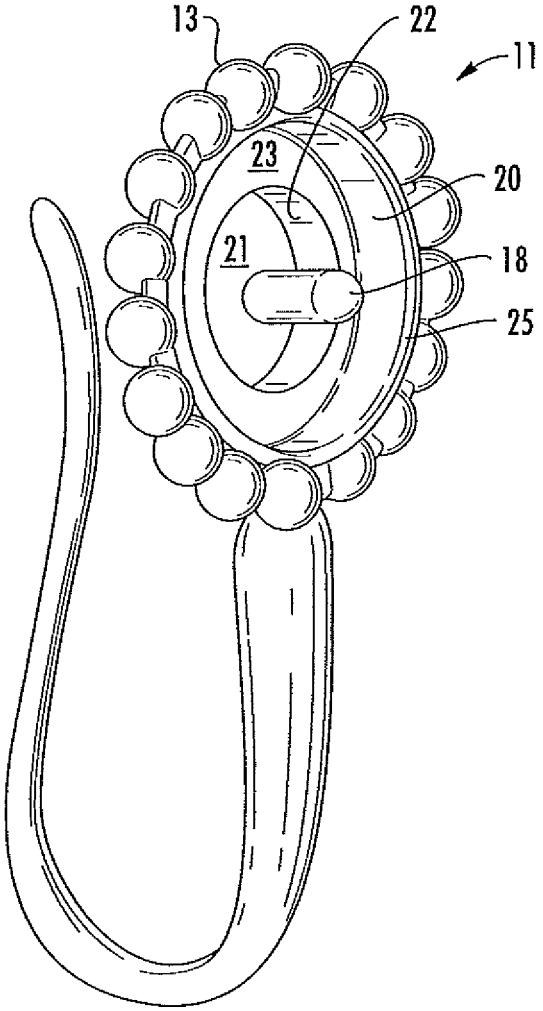
FIG. 1 is a front perspective view of the base housing of this earring invention with a post and a recess to accept and hold a magnetic element.

FIG. 1 is a front perspective view of the earring base housing 11 into which the decorative element 12 is seated. Housing 11 generally accommodates and holds decorative element 12. Housing 11 has an annular outer decorated structure 13 which has a central annular recess 20 sized to accept decorative element 12 and hold the decorative element therein. A further smaller central annular recess 22 formed within annular recess 20 terminates in an annular floor or rear wall 21. A pin 18 projects outwardly from rear wall 21. The size and depth of annular recess 20 is determined by the size of the jewelry element, such as the size of a pearl to be held in base housing 11. An annular magnet 24 sits on rear wall 21 in recess 22 and has a central opening 26 to accommodate pin 18. Magnet 24 is located substantially flush with floor 23 of recess 20.

Pin 18 has a height which projects slightly above the plane 25 of the top surface of recess 20 on which the rear 8 of decorative element 12 sits. Thus, the top of pin 18 projects above the front surface 25 to facilitate attachment and removal of the decorative element 12 to the base housing 11. The pin 18 being held in aperture 16 and bore 17 also prevents the magnetically held base housing 11 and decorative element 12 from sliding apart. Pin 18 thus serves to locate the aperture 16 and bore 17 in earring 12 to facilitate assembly of the earring.

While pin or post 18 is described as having a height to extend above front surface 25, it could be lower, but in any case, pin 18 slides onto recess 16 of decorative element 12, and magnet 14 is thereby attracted to magnet 24 held in recess 22. The spacing between magnets 14 and 24 can be almost nonexistent depending on how the respective magnets sit in their respective recesses.

As can be seen, the magnet 24 of the housing 11 attracts the magnet 14 of the decorative element so that it is securely attached to housing 11.

As another alternative, one can use only a single magnet since the detachable ornament could be made of metal or the detachable ornament could have metal embedded in recess 10, which also would be attracted to a magnet and therefore not need the use of two separate magnets. Furthermore, the reverse may also be possible where the magnet could be embedded in the recess 10, and a round piece of metal could be attached in the earring annular recess 22, enabling the attraction of the ornament to the earring. It may be preferable to use only a single magnet in the base to avoid the replaceable decorative elements, such as a pearl, having a magnet because of the possibility that such magnet may attach other metal items when the pearl is not attached to the housing.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. An earring comprising a base housing and a separable and replaceable decorative jewelry element, said base housing sized to accommodate and receive said jewelry element, said base housing sized to directly contact and nest said decorative jewelry element therein, said base housing comprising a small annular recess and a pin projecting from said small annular recess, said small annular recess having a top surface and a plane defining said top surface and a bottom surface and an annular wall connecting said top and bottom surfaces of said small annular recess, said pin connected to said bottom surface and having a top, said top of said pin projecting above said plane of said top surface of said small annular recess, said replaceable decorative element having a front and a rear surface, said rear surface having a bore to receive said pin, said pin locating said replaceable decorative element and facilitating assembly of said earring, said base housing and said replaceable decorative element being magnetically attracted to and physically touching each other and held together by magnetic attraction, said base housing and said decorative element separable from each other, with a magnet attached to either said base housing or said replaceable decorative element, said magnet physically touching said base housing or said replaceable decorative element when said base housing and said decorative element are physically touching each other and are held together by magnetic attraction, said base housing comprising a larger annular recess, coaxial with said small annular recess, said larger annular recess having a bottom surface coextensive with said plane of said top surface of said small annular recess, said decorative element sitting on said bottom surface of said larger annular recess.

2. The earring of claim 1, wherein each of said base housing and said replaceable decorative element comprises a magnet, said magnets in said respective base housing and replaceable decorative element being in facing relationship when said base housing and replaceable decorative element are attached together.

3. The earring of claim 1, wherein said replaceable decorative element comprises a metal component, said base housing comprising a magnet, said metal component being magnetically attracted to said magnet in said base housing.

* * * * *